US007016632B2

(12) United States Patent
Bares et al.

(10) Patent No.: US 7,016,632 B2
(45) Date of Patent: Mar. 21, 2006

(54) ELECTROPHOTOGRAPHIC TONER AND DEVELOPMENT PROCESS USING CHEMICALLY PREPARED TONER

(75) Inventors: Jan Bares, Webster, NY (US); James H. Anderson, Rochester, NY (US); Matthew Ezenyilimba, Walworth, NY (US); William K. Goebel, Springwater, NY (US)

(73) Assignee: Eastman Kodak Company, Rochester, NY (US)

( * ) Notice: Subject to any disclaimer, the term of this patent is extended or adjusted under 35 U.S.C. 154(b) by 31 days.

(21) Appl. No.: 10/602,112

(22) Filed: Jun. 23, 2003

(65) Prior Publication Data

US 2004/0096243 A1 May 20, 2004

Related U.S. Application Data

(60) Provisional application No. 60/390,955, filed on Jun. 24, 2002.

(51) Int. Cl.
*G03G 9/083* (2006.01)

(52) U.S. Cl. ..... 399/267; 430/106.1; 430/108.6; 430/108.7; 430/122

(58) Field of Classification Search ..... 399/267; 430/106.1, 108.6, 108.7, 122
See application file for complete search history.

(56) References Cited

U.S. PATENT DOCUMENTS

| | | | | |
|---|---|---|---|---|
| 2,229,513 | A | 1/1941 | Lustig et al. | 217/60 |
| 3,716,630 | A | 2/1973 | Shirk | 423/594 |
| 3,893,935 | A | 7/1975 | Jadwin et al. | 252/62.1 |
| 3,938,992 | A | 2/1976 | Jadwin et al. | 96/1 |
| 3,941,898 | A | 3/1976 | Sadamatsu et al. | 427/18 |
| 4,046,990 | A | 9/1977 | White | 219/471 |
| 4,076,857 | A | 2/1978 | Kasper et al. | 427/18 |
| 4,079,014 | A | 3/1978 | Burness et al. | 252/62.1 |
| 4,085,702 | A | 4/1978 | Consaul et al. | 118/60 |
| 4,160,644 | A | 7/1979 | Ryan | 23/230 B |
| 4,323,634 | A | 4/1982 | Jadwin | 430/110 |
| RE31,072 | E | 11/1982 | Jadwin et al. | 430/99 |
| 4,385,823 | A | 5/1983 | Kasper et al. | 355/3 R |
| 4,394,430 | A | 7/1983 | Jadwin et al. | 430/110 |
| 4,395,109 | A | 7/1983 | Nakajima et al. | 355/3 FU |
| 4,414,152 | A | 11/1983 | Santilli et al. | 260/185 |
| 4,416,965 | A | 11/1983 | Sandhu et al. | 430/109 |
| 4,473,029 | A | 9/1984 | Fritz et al. | 118/657 |
| 4,515,884 | A | 5/1985 | Field et al. | 430/99 |
| 4,546,060 | A | 10/1985 | Miskinis et al. | 430/108 |
| 4,624,907 | A | 11/1986 | Niimura et al. | 430/106 |
| 4,683,188 | A | 7/1987 | Suzuki et al. | 430/110 |
| 4,780,553 | A | 10/1988 | Suzuki et al. | 556/26 |
| 4,810,858 | A | 3/1989 | Urban et al. | 219/469 |
| 4,814,250 | A | 3/1989 | Kwarta et al. | 430/110 |
| 4,833,060 | A | 5/1989 | Nair et al. | 430/137 |
| 4,834,920 | A | 5/1989 | Bugner et al. | 260/501.15 |
| 4,840,864 | A | 6/1989 | Bugner et al. | 430/110 |
| 4,912,009 | A | 3/1990 | Amering et al. | 430/137 |
| 4,927,727 | A | 5/1990 | Rimai et al. | 430/99 |
| 4,965,131 | A | 10/1990 | Nair et al. | 428/407 |
| 4,968,578 | A | 11/1990 | Light et al. | 430/126 |
| 5,057,392 | A | 10/1991 | McCabe et al. | 430/109 |
| 5,084,735 | A | 1/1992 | Rimai et al. | 355/271 |
| 5,089,547 | A | 2/1992 | McCabe et al. | 524/262 |
| 5,102,765 | A | 4/1992 | McCabe et al. | 430/110 |
| 5,112,715 | A | 5/1992 | DeMejo et al. | 430/109 |
| 5,147,747 | A | 9/1992 | Wilson et al. | 430/109 |
| 5,376,492 | A | 12/1994 | Stelter et al. | 430/122 |
| 5,394,230 | A | 2/1995 | Kaukeinen et al. | 355/326 |
| 5,409,791 | A | 4/1995 | Kaukeinen et al. | 430/54 |
| 5,489,497 | A * | 2/1996 | Young et al. | 430/106.2 |
| 5,489,975 | A | 2/1996 | Kaukeinen et al. | 355/251 |
| 5,534,347 | A | 7/1996 | Chen et al. | 428/375 |
| 5,595,823 | A | 1/1997 | Chen et al. | 428/421 |
| 5,606,404 | A | 2/1997 | Hilbert et al. | 399/267 |
| 5,629,061 | A | 5/1997 | Kass | 428/35.8 |
| 5,728,496 | A | 3/1998 | Rimai et al. | 430/47 |
| 5,731,121 | A * | 3/1998 | Asanae et al. | 430/108.4 |
| 5,780,195 | A | 7/1998 | Nava | 430/110 |
| 5,985,499 | A | 11/1999 | Guth et al. | 430/42 |
| 6,067,438 | A | 5/2000 | Chen et al. | 399/325 |
| 6,096,429 | A | 8/2000 | Chen et al. | 428/421 |
| 6,200,722 | B1 * | 3/2001 | Fields et al. | 430/137.21 |
| 6,766,136 | B1 * | 7/2004 | Jadwin et al. | 399/267 |
| 6,797,448 | B1 * | 9/2004 | Fields et al. | 430/122 |
| 2003/0008227 | A1 | 1/2003 | Ezenyilimba et al. | 430/137.14 |
| 2003/0013032 | A1 | 1/2003 | Fields et al. | 430/122 |
| 2003/0073017 | A1 | 4/2003 | Fields et al. | 430/108.1 |

FOREIGN PATENT DOCUMENTS

| | | |
|---|---|---|
| EP | 1420839 | 9/1979 |
| GB | 3905 | 1/1976 |
| GB | 1501065 | 2/1978 |

OTHER PUBLICATIONS

Bouk et al., "Measurement of Graininess for Halftone Electrophotography" Recent Progress in Digital Halftoning, pp. 166-170.
U.S. Appl. No. 09/814,923, filed Mar. 22, 2001.
U.S. Appl. No. 10/403,539, filed Mar. 31, 2003.

* cited by examiner

*Primary Examiner*—Mark A. Chapman
(74) *Attorney, Agent, or Firm*—Kathleen Neuner Manne

(57) ABSTRACT

Development systems and methods for developing using chemically prepared toners are disclosed. The present invention further discloses developers used in development systems. The use of chemically prepared toners with hard magnetic carrier particles with a non-magnetic, cylindrical shell for transporting developers provides excellent benefits with respect to image quality by reducing granularity and by providing a typically constant, stable developer life as shown by the consistent level of charge to mass over time during operation.

23 Claims, 4 Drawing Sheets

ELECTROPHOTOGRAPHIC TONER AND DEVELOPMENT PROCESS USING CHEMICALLY PREPARED TONER

This application claims the benefit under 35 U.S.C. §119 (e) of prior U.S. Provisional Patent Application No. 60/390,955 filed Jun. 24, 2002, which is incorporated in its entirety by reference herein.

BACKGROUND OF THE INVENTION

The present invention relates to development systems for toners and more particularly relates to the use of chemically prepared toners in development systems.

Digital printers and similar devices have a number of properties that need to be achieved in order to provide a satisfactory toner image, especially with respect to high speed digital printers. One property that can be improved is image quality, which sometimes is affected by high levels of granularity in the image. In addition, a relatively constant and stable developer life during use of a digital printer or other printer/copier device is very desirable in order to maintain a constant image quality.

Further, in two-component developer systems, there is often a build-up of fine toner which does not become part of the toner image but remains in the printer. This buildup of fine toner over time can create dusting problems wherein the dusting problem makes itself apparent on the toner image and therefore diminishes toner image.

Accordingly, there is a need to provide a development system that produces prints with high image quality and further is not affected by any buildup of fine toner during the developing process. In addition, there is a need to provide an improved charge stability over time and thus avoid any of the above-described disadvantages.

SUMMARY OF THE PRESENT INVENTION

A feature of the present invention is to provide a development system which provides a printed image having sharp image quality.

Another feature of the present invention is to provide a development system which is substantially unaffected by the buildup of fine toner and thus avoids dusting problems.

A further feature of the present invention is to provide methods to improve charge stability over time.

Additional features and advantages of the present invention will be set forth in part in the description which follows, and in part will be apparent from the description, or may be learned by practice of the present invention. The objectives and other advantages of the present invention will be realized and attained by means of the elements and combinations particularly pointed out in the written description and appended claims.

To achieve these and other advantages and in accordance with the purposes of the present invention, as embodied and broadly described herein, the present invention relates to a development system utilizing dry toners. The development system includes a supply of dry developer mixture which contains toner particles and hard magnetic carrier particles. The development system further includes a non-magnetic, cylindrical shell for transporting the developer between the supply and the development zone wherein the shell can be rotatable or stationary. A rotating magnetic core of a pre-selected magnetic field strength and means for rotating at least the magnetic core to provide for the transport of the toner particles from the shell to an electrostatic image are also provided as part of the development system. The development system optionally further includes a fusing roll coated with silicone rubber or other low surface energy elastomers or resins. Preferably, the fusing roll is a filled silicone rubber fusing roller.

The toner used in the development system is a chemically prepared toner ("CPT") containing at least one toner resin, and preferably at least one release agent, at least one surface treatment agent, and optionally at least one colorant and/or at least one charge control agent.

The present invention further relates to a method for developing an electrostatic image with the above-described chemically prepared toner. The method involves developing an electrostatic image member bearing an electrostatic image pattern by moving the image member through a development zone and transporting developer through the development zone in developing relation with the charge pattern of the moving imaging member by rotating an alternating-pole magnetic core of a pre-selected magnetic field strength within an outer non-magnetic shell, which can be rotating or stationary, and controlling the directions and speeds of the core and optionally the shell rotations so that developer flows through the development zone in a direction co-current with the image member movement, wherein an electrographic two-component dry developer composition is preferably used. The method can further involve transferring the chemically prepared toner to a substrate and the substrate with the toner image is then subsequently fused by passing the toner image on the substrate through a fuser to fuse the image on the substrate wherein the fusing roll is preferably a silicone rubber coated fusing roller or is coated with other low surface energy elastomers or resins. The fuser roll is preferably in a pressure contact arrangement with a backup or pressure roll. The dry developer composition contains charged toner particles and oppositely charged carrier particles. Preferably, the carrier particles are a hard magnetic material exhibiting a coercivity of at least about 300 gauss when magnetically saturated and also exhibit an induced magnetic moment of at least about 20 EMU/gm when in an externally applied field of 1,000 gauss. The carrier particles have a sufficient magnetic moment to prevent the carrier particles from transferring to the electrostatic image.

The present invention also relates to a developer which contains the above-described chemically prepared toner particles with hard magnetic carrier particles.

It is to be understood that both the foregoing general description and the following detailed description are exemplary and explanatory only and are intended to provide a further explanation of the present invention, as claimed.

DETAILED DESCRIPTION OF THE PRESENT INVENTION

Figure 1:
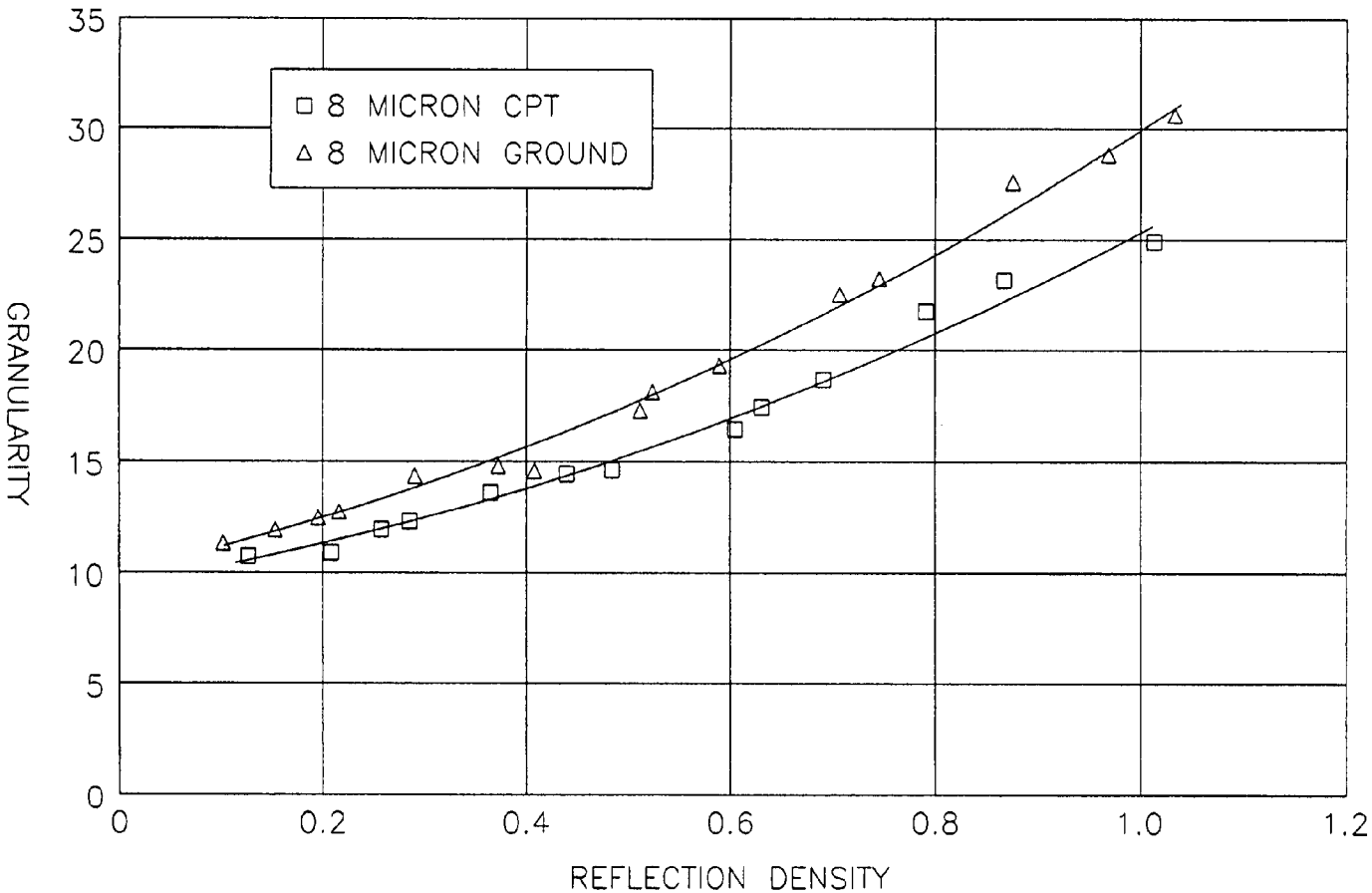
FIG. 1 is a graph comparing ground toner with chemically prepared toner with respect to granularity.

The present invention relates to development systems and methods for developing using chemically prepared toners.

The present invention further relates to the developer used in the development system as well as the chemically prepared toner in the developer.

In more detail, the present invention, in part, relates to a development system. The development system contains a supply of dry developer mixture which includes chemically prepared toner and hard magnetic carrier particles. A non-magnetic, cylindrical shell which can be a stationary shell or a rotating shell is used for transporting the developer mixture from the supply to the development zone. A magnetic core which includes a plurality of magnetic pole portions is arranged around the core periphery in alternating magnetic polarity relation and which is rotatable on an axis within the non-magnetic, cylindrical shell. Furthermore, means for rotating the core and optionally the shell are present in order to deliver the developer mixture to the development zone wherein the chemically prepared toner of the developer is transferred to the electrostatic image.

The development system of the present invention further includes a fuser roll which is preferably coated with a silicone rubber or other low surface energy elastomer or resin. The fuser roll is preferably in a pressure contact arrangement with a backup or pressure roll. In this assembly, both the fuser roll and the pressure roll are pressed against each other under sufficient pressure to form a nip. It is in this nip that the fusing or fixing takes place.

The toner particles that are used in the development system are chemically prepared toners. The chemically prepared toners contain at least one toner resin, and preferably contain at least one release agent, at least one surface treatment agent, and optionally at least one colorant, at least one charge control agent, other conventional toner components, or combinations thereof. The use of these chemically prepared toner particles in combination with the particular development system described herein preferably results in an image which has improved image quality along with excellent charge stability over time and the avoidance of dusting problems from the buildup of fine toner in the development system.

The set up of the development system is preferably a digital printer, such as a Heidelberg Digimaster 9110 printer using a development station comprising a non-magnetic, cylindrical shell, a magnetic core, and means for rotating the core and optionally the shell as described, for instance, in detail in U.S. Pat. Nos. 4,473,029 and 4,546,060, both incorporated in their entirety herein by reference. The development systems described in these patents can be adapted for use in the present invention. In more detail, the development systems described in these patents preferably use hard magnetic carrier particles. For instance, the hard magnetic carrier particles can exhibit a coercivity of at least about 300 gauss when magnetically saturated and also exhibit an induced magnetic moment of at least about 20 EMU/gm when in an externally applied field of 1,000 gauss. The magnetic carrier particles can be binder-less carriers or composite carriers. Useful hard magnetic materials include ferrites and gamma ferric oxide. Preferably, the carrier particles are composed of ferrites, which are compounds of magnetic oxides containing iron as a major metallic component. For example, compounds of ferric oxide, $Fe_2O_3$, formed with basic metallic oxides such as those having the general formula $MFeO_2$ or $MFe_2O_4$ wherein M represents a mono- or di-valent metal and the iron is in the oxidation state of +3. Preferred ferrites are those containing barium and/or strontium, such as $BaFe_{12}O_{19}$, $SrFe_{12}O_{19}$, and the magnetic ferrites having the formula $MO.6\ Fe_2O_3$, wherein M is barium, strontium, or lead as disclosed in U.S. Pat. No, 3,716,630 which is incorporated in its entirety by reference herein. The size of the magnetic carrier particles useful in the present invention can vary widely, and preferably have an average particle size of less than 100 microns, and more preferably have an average carrier particle size of from about 5 to about 45 microns.

For purposes of the present invention, the chemically prepared toner used in the present invention is a toner which is not prepared by grinding bulk polymer materials to a suitable particle size and/or particle size distribution. Chemically prepared toners are toners which are prepared by a chemical process wherein the polymers or toner resin which forms the majority of the toner particle is formed by a polymerization process such as emulsion and/or suspension polymerization techniques. These techniques typically form the polymeric powder in a suitable particle size and/or particle size distribution without any need for grinding. Suitable techniques and particles which can be used in the present invention are described, for instance, in U.S. Pat. Nos. 4,833,060 and 4,965,131 incorporated in their entirety by reference herein. The polymer may be made using a limited coalescence reaction such as the suspension polymerization procedure disclosed in U.S. Pat. No. 4,912,009 to Amering et al., which is incorporated in its entirety by reference herein. For purposes of the present invention, the chemically prepared toner particles preferably have a particle size of about 6 microns or less and more preferably from about 1 to about 6 microns and more preferably from about 3 to about 4 microns depending upon the image quality desired. The chemically prepared toners described in U.S. patent application Ser. No. 09/814,899, entitled "Method For Forming Toner Particles Having Controlled Morphology And Containing Quaternary Ammonium Tetraphenylborate Charge Control Agents," filed Mar. 22, 2001, and U.S. patent application Ser. No. 09/814,923, entitled "Method For Forming Toner Particles Having Controlled Morphology And Containing A Quaternary Ammoniuim Tetraphenylborate And A Polymeric Phosphonium Salt," filed Mar. 22, 2001, can also be used in the present invention and these patent applications are incorporated in their entirety by reference herein.

The toner particles can include one or more toner resins which can be optionally colored by one or more colorants as described in U.S. Pat. No. 4,833,060. Although coloring is optional, normally a colorant is present and can be any of the materials mentioned in *Colour Index,* Volumes I and II, Second Edition, incorporated herein by reference. The toner resin can be selected from a wide variety of materials including both natural and synthetic resins and modified natural resins as disclosed, for example, in U.S. Pat. Nos. 4,076,857; 3,938,992; 3,941,898; 5,057,392; 5,089,547; 5,102,765; 5,112,715; 5,147,747; 5,780,195 and the like, all incorporated herein by reference. Preferred resin or binder materials include polyesters and styrene-acrylic copolymers. The shape of the toner particles can be any shape, regular or irregular, such as spherical particles, which can be obtained by spray-drying a solution of the toner resin in a solvent. Alternatively, spherical particles can be prepared by the polymer bead swelling techniques, such as those described in European Patent No. 3905 published Sep. 5, 1979, which is incorporated in its entirety by reference herein. Typically, the amount of toner resin present in the toner formulation is from about 80% to about 95% by weight of the toner formulation.

Useful binder polymers include vinyl polymers, such as homopolymers and copolymers of styrene. Styrene polymers include those containing 40 to 100 percent by weight of styrene, or styrene homologs, and from 0 to 40 percent by weight of one or more lower alkyl acrylates or methacrylates. Other examples include fusible styrene-acrylic copolymers that are covalently lightly crosslinked with a divinyl compound such as divinylbenzene. Binders of this type are described, for example, in U.S. Reissue Pat. No. 31,072, which is incorporated in its entirety by reference wherein. Preferred binders comprise styrene and an alkyl acrylate and/or methacrylate and the styrene content of the binder is preferably at least about 60% by weight.

Copolymers rich in styrene such as styrene butylacrylate and styrene butadiene are also useful as binders as are blends of polymers. In such blends, the ratio of styrene butylacrylate to styrene butadiene can be 10:1 to 1:10. Ratios of 5:1 to 1:5 and 7:3 are particularly useful. Polymers of styrene butylacrylate and/or butylmethacrylate (30 to 80% styrene) and styrene butadiene (30 to 80% styrene) are also useful binders.

Styrene polymers include styrene, alpha-methylstyrene, para-chlorostyrene, and vinyl toluene; and alkyl acrylates or methylacrylates or monocarboxylic acids having a double bond selected from acrylic acid, methyl acrylate, 2-ethylhexyl acrylate, 2-ethylhexyl methacrylate, ethyl acrylate, butyl acrylate, dodecyl acrylate, octyl acrylate, phenylacrylate, methylacrylic acid, ethyl methacrylate, butyl methacrylate and octyl methacrylate and are also useful binders. Also useful are condensation polymers such as polyesters and copolyesters of aromatic dicarboxylic acids with one or more aliphatic diols, such as polyesters of isophthalic or terephthalic acid with diols such as ethylene glycol, cyclohexane dimethanol, and bisphenols.

A useful binder can also be formed from a copolymer of a vinyl aromatic monomer; a second monomer selected from either conjugated diene monomers or acylate monomers such as alkyl acrylate and alkyl methacrylate.

The optional surface treatment with a surface treatment agent or a spacing agent preferably reduces the attraction between the chemically prepared toner particles and the hard magnetic carrier particles to a degree sufficient that the chemically prepared toner particles are transported by the carrier particles to the development zone where the electrostatic image is present and then the chemically prepared toner particles leave the carrier particles due at least in part to the sufficient electrostatic forces associated with the charged image. Accordingly, the preferred chemically prepared toner particles of the present invention permit attraction with the magnetic carrier particles but further permit the stripping of the chemically prepared toner particles from the hard magnetic carrier particles by the electrostatic and/or mechanical forces and with surface treatment on the chemically prepared toner particles. In other words, the spacing agent on the surface of the chemically prepared toner particles, as indicated above, is sufficient to reduce the attraction between the chemically prepared toner particles and the hard magnetic carrier particles such that the chemically prepared toner particles can be stripped from the carrier particles by the electrostatic forces associated with the charged image or by mechanical forces.

The preferred spacing agent is silica, such as those commercially available from Degussa, like R-972, or from Wacker, like H2000. Other suitable spacing agents include, but are not limited to, other inorganic oxide particles and the like. Specific examples include, but are not limited to, titania, alumina, zirconia, and other metal oxides; and also polymer beads preferably less than 1 $\mu$m in diameter (more preferably about 0.1 $\mu$m), such as acrylic polymers, silicone-based polymers, styrenic polymers, fluoropolymers, copolymers thereof, and mixtures thereof.

The amount of the spacing agent on the toner particles is an amount sufficient to permit the toner particles to be stripped from the magnetic carrier particles by the electrostatic forces associated with the charged image or by mechanical forces. Preferred amounts of the spacing agent are from about 0.05 to about 10.0 wt %, and more preferably from about 0.1 to about 1.0 wt %, and most preferably from about 0.2 to about 0.6 wt %, based on the weight of the toner, and depending on the particle size. The smaller the toner particles, the more spacing agent is preferably used.

The spacing agent can be applied onto the surfaces of toner particles by conventional surface treatment techniques such as, but not limited to, conventional mixing techniques, such as tumbling the toner particles in the presence of the spacing agent. Preferably, the spacing agent is distributed on the surface of the toner particles. The spacing agent is attached onto the surface of the toner particles and can be attached by electrostatic forces or physical means or both. With mixing, preferably uniform mixing is preferred and achieved by such mixers as a high energy Henschel-type mixer which is sufficient to keep the spacing agent from agglomerating or at least minimizes agglomeration. Furthermore, when the spacing agent is mixed with the magnetic toner particles in order to achieve distribution on the surface of the toner particles, the mixture can be sieved to remove any agglomerated spacing agent. Other means to separate agglomerated particles can also be used for purposes of the present invention.

In the present invention, at least one release agent is preferably present in the toner formulation. An example of a suitable release agent is one or more waxes. Useful release agents are well known in this art. Useful release agents include low molecular weight polypropylene, natural waxes, low molecular weight synthetic polymer waxes, commonly accepted release agents, such as stearic acid and salts thereof, and others.

The wax is preferably present in an amount of from about 0.1 to about 10 wt % and more preferably in an amount of from about 0.5 to about 5 wt % based on the toner weight. Examples of suitable waxes include, but are not limited to, polyolefin waxes, such as low molecular weight polyethylene, polypropylene, copolymers thereof and mixtures thereof. In more detail, more specific examples are copolymers of ethylene and propylene preferably having a molecular weight of from about 1000 to about 5000 g/mole, particularly a copolymer of ethylene and propylene having a molecular weight of about 1200 g/mole. Additional examples include synthetic low molecular weight polypropylene waxes preferably having a molecular weight from about 3,000 to about 15,000 g/mole, such as a polypropylene wax having a molecular weight of about 4000 g/mole. Other suitable waxes are synthetic polyethylene waxes. Suitable waxes are waxes available from Mitsui Petrochemical, Baker Petrolite, such as Polywax 2000, Polywax 3000, and/or Unicid 700; and waxes from Sanyo Chemical Industries such as Viscol 550P and/or Viscol 660P. Other examples of suitable waxes include waxes such as Licowax PE130 from Clarient Corporation.

In a typical manufacturing process, the desired polymeric binder for toner application is produced. Polymeric binders for electrostatographic toners are commonly made by polymerization of selected monomers followed by mixing with various additives and then grinding to a desired size range. During toner manufacturing, the polymeric binder is subjected to melt processing in which the polymer is exposed to moderate to high shearing forces and temperatures in excess of the glass transition temperature of the polymer. The temperature of the polymer melt results, in part, from the frictional forces of the melt processing. The melt processing includes melt-blending of toner addenda into the bulk of the polymer.

The term "charge-control" refers to a propensity of a toner addendum to modify the triboelectric charging properties of the resulting toner. A very wide variety of optional charge control agents for positive and negative charging toners are available and can be used in the toners of the present invention. Suitable charge control agents are disclosed, for example, in U.S. Pat. Nos. 3,893,935; 4,079,014; 4,323,634; 4,394,430; and British Patent Nos. 1,501,065 and 1,420,839, all of which are incorporated in their entireties by reference herein. Additional charge control agents which are useful are described in U.S. Pat. Nos. 4,624,907; 4,814,250; 4,840,864; 4,834,920; 4,683,188; and 4,780,553, all of which are incorporated in their entireties by reference herein. Mixtures of charge control agents can also be used. Particular examples of charge control agents include chromium salicylate organo-complex salts, and azo-iron complex-salts, an azo-iron complex-salt, particularly ferrate (1-), bis[4-[(5-chloro-2-hydroxyphenyl)azo]-3-hydroxy-N-phenyl-2-naphthalenecarboxamidato(2-)], ammonium, sodium, and hydrogen (Organoiron available from Hodogaya Chemical Company Ltd.).

An optional additive for the toner is a colorant. In some cases the magnetic component, if present, acts as a colorant negating the need for a separate colorant. Suitable dyes and pigments are disclosed, for example, in U.S. Reissue Pat. No. 31,072 and in U.S. Pat. Nos. 4,160,644; 4,416,965; 4,414,152; and 2,229,513, all incorporated in their entireties by reference herein. One particularly useful colorant for toners to be used in black and white electrostatographic copying machines and printers is carbon black. Colorants are generally employed in the range of from about 1 to about 30 weight percent on a total toner powder weight basis, and preferably in the range of about 2 to about 15 weight percent. The toner formulations can also contain other additives of the type used in conventional toners, including magnetic pigments, leveling agents, surfactants, stabilizers, and the like.

The remaining components of toner particles as well as the hard magnetic carrier particles can be conventional ingredients. For instance, various resin materials can be optionally used as a coating on the hard magnetic carrier particles, such as fluorocarbon polymers like poly (tetrafluoro ethylene), poly(vinylidene fluoride) and polyvinylidene fluoride-co-tetrafluoroethlyene). Examples of suitable resin materials for the carrier particles include, but are not limited to, silicone resin, fluoropolymers, polyacrylics, polymethacrylics, copolymers thereof, and mixtures thereof, other commercially available coated carriers, and the like.

The present invention further relates to methods of forming images using the chemically prepared toners and developers of the present invention. Generally, the method includes forming an electrostatic latent image on a surface of an electrophotographic element and developing the image by contacting the latent image with the toner/developer of the present invention.

The present invention further relates to the use of the above-described development system in developing electrostatic images with the chemically prepared toner of the present invention. The method involves contacting an electrostatic image with the chemically prepared toner of the present invention. For example, the method involves developing an electrostatic image member bearing an electrostatic image pattern by moving the image member through a development zone and transporting developer through the development zone in developing relation with the charge pattern of the moving imaging member by rotating an alternating-pole magnetic core of a pre-selected magnetic field strength within an outer non-magnetic shell, which can be rotating or stationary, and controlling the directions and speeds of the core and optionally the shell rotations so that developer flows through the development zone in a direction co-current with the image member movement, wherein an electrographic two-component dry developer composition is preferably used. The dry developer composition contains charged toner particles and oppositely charged carrier particles. The carrier particles are preferably a hard magnetic material exhibiting a coercivity of at least about 300 gauss when magnetically saturated and also exhibit an induced magnetic moment of at least about 20 EMU/gm when in an externally applied field of 1,000 gauss. The carrier particles have a sufficient magnetic moment to prevent the carrier particle from transferring to the electrostatic image. The various methods described in U.S. Pat. Nos. 4,473,029 and 4,546,060 can be used in the present invention using the toner of the present invention in the manners described herein, and these patents are incorporated in their entirety by reference herein.

The electrostatic image so developed can be formed by a number of methods such as by imagewise photodecay of a photoreceptor or imagewise application of a charge pattern on the surface of a dielectric recording element. When photoreceptors are used, such as in high-speed electrophotographic copy devices, the use of half-tone screening to modify an electrostatic image is particularly desirable; the combination of screening with development in accordance with the method of the present invention producing high-quality images exhibiting high Dmax and excellent tonal range. Representative screening methods include those employing photoreceptors with integral half-tone screen, such as those described in U.S. Pat. No. 4,385,823, incorporated in its entirety by reference herein.

The development system of the present invention can further include a fuser roll which can be optionally coated with a silicone rubber or other low surface energy elastomet or resin such as tetrafluoroethylene resin. The silicone rubbers which can be used as the surface of the fuser member can be a room temperature vulcanization silicone rubber, a low temperature vulcanization silicone rubber, or a high temperature vulcanization type silicone rubber. The fuser roll can be any shape such as a plate or belt but is preferably cylindrical. Preferably, the fuser roll is composed of a core having coated thereon a thin layer of a silicone rubber. The core may be made of various metals such as iron, aluminum, nickel, stainless steel, and the like or other resilient materials such as various synthetic resins. The core is preferably hollow and a heating element is generally positioned inside the hollow core to supply the heat for the fusing operation. Heating elements suitable for this purpose are known to those skilled in the art and may be a quartz heater made of a quartz envelope having a tungsten resistant heating element disposed internally thereof. The method of providing the necessary heat in the fuser roll is not critical to the present invention and the fuser member can be heated by internal means, external means, or a combination of both. All heating means are well known to those skilled in the art for providing sufficient heat to fuse the toner to the support. The fuser roll is preferably in a pressure contact arrangement with a backup or pressure roll. The pressure roll preferably is a metal core with a layer of a heat-resistant material. In this assembly, both the fuser roll and the pressure roll are mounted on shafts which are biased so that the fuser roll and pressure roll are pressed against each other under sufficient pressure to form a nip. It is in this nip that the fusing or fixing takes place. The quality of the copies produced by the fuser assembly is better when the nip is formed by a relatively hard and unyielding layer with a relatively flexible layer. In this manner, the nip is formed by a slight deformation in the layer due to the biasing of the fuser roll and the pressure roll. The relatively hard and unyielding layer may be made of any well known material such as polyfluoroethylene, propylene, or a silicone rubber, or other similar materials. In the present invention, the fusing occurs when a sheet of a support material such as a sheet of paper bearing thereon a toner image passes between the fuser roll and the pressure roll. The fuser roll then fuses the toner image onto the support material thus forming a printed image on the substrate. With the above-described development system using the particular fuser assembly described herein along with the particular toner formulations described herein, excellent image quality along with good fusing quality is accomplished with respect to the printed image. The excellent image quality can be seen, for instance in the solid area reflection density set forth in the following examples and the good fusing quality can be primarily seen in the ruboff values provided in the following examples as well as the crack width data provided in the examples. Thus, the present invention provides a means to accomplish a balancing of properties, namely image quality with fusing quality and in a system that provides high speed digital copying in a two component system. The fuser assembly and other details of development and subsequent processing that can be used in the present invention in combination with the particular toner formulations described herein as well as the development system are described in detail in, for instance, U.S. Pat. Nos. 5,534,347, 5,629,061, 3,938,992, 4,046,990, 4,085,702, RE 31,072, 4,810,858, 4,395,109, 6,096,429, 6,067,438, 4,515,884, 5,728,496, 5,084,735, 4,968,578, 4,927,727, and 5,595,823. All of these patents are incorporated in their entirety by reference herein.

The various options described in these patents such as the use of a particular silicone rubber or other optional components such as the use of silicone or siloxane oil can be incorporated into the present invention.

Developers in the development system of the present invention are preferably capable of delivering toner to a charged image at high rates and hence are particularly suited to high-volume electrophotographic printing applications and copying applications.

The prints resulting from the development process of the present invention have, as stated above, improved image quality in combination with excellent fusing quality. The printed images when fused on a substrate such as a sheet of paper have improved abrasion resistance, reduced "toner ruboff", even when fed in friction fed finishing equipment.

As an alternative embodiment, instead of using a spacing agent on the toner particles, the transfer potential can be significantly increased such that the electrostatic forces associated with the charged image are quite high, such as from about 1,000 volts to about 2,500 so that these electrostatic charges are sufficient to strip the toner particles away from the carrier particles.

Another alternative way of using the development system of the present invention is to increase the speed of the rotating magnetic core which permits the shaking of the toner particles to such an extent that their stripping from the carrier particles is possible. The speed of the rotating core is at least about 100 rpm or at least about 500 rpm. With respect to this embodiment, the speed of the rotating magnetic core is at least about 1,000 rpm and can be at least about 2,000 rpm or at least about 2,500 rpm, and more preferably is from about 500 to about 2,500 rpm. These various embodiments described above can be used in various combinations as well.

An additional alternative way of using the development system of the present invention is to add an AC bias in superposition with the DC bias of the toning station. The AC bias agitates the toner particles so that the stripping of toner particles from carrier particles is enhanced. The AC bias waveform preferably has a frequency of from about 300 Hz to about 3000 Hz and peak-to-peak amplitudes of from about 0.2 kV to about 5 kV; and most preferably range from about 1000 to about 1500 Hz, or from about 1000 to about 3000 Hz, with about 0.2 to about 3 kV peak-to-peak, or from about 2 to about 3 kV peak-to-peak. AC voltages having the form of a trapezoidal wave and most preferably a square wave are preferable to waveforms with lower average rms voltage, such as sine waves or triangle waves. The usefulness of AC bias as a means of enhancing image density and reducing undesirable side effects of toning in conjunction with toning stations having a rotating magnetic core is described in U.S. Pat. Nos. 5,376,492; 5,394,230; 5,409,791; 5,489,975; 5,606,404; and 5,985,499. All of the various embodiments described above can be used in various combinations as well.

As indicated above, the development system of the present invention which makes use of chemically prepared toners has the advantage of reducing significantly any dusting problems which are created during development operations. While not specifically understood, the buildup of fine toner during the development operation does not create any dusting problems in the present invention which is unlike previous development systems using ground toners. In addition, the charge stability over time with the development system of the present invention is considerably improved and stable over many hours of operation, such as over 100 hours. This is further shown, for instance, in one of the examples where a comparison of ground toner and chemically prepared toner is shown, using the same development system. Also, the charge stability (e.g., −Q/m) is considerably stable over time for the chemically prepared toner systems in the development system of the present invention. In addition, with the avoidance of dusting problems, the image quality provided by the development system of the present invention is significantly improved.

The present invention can be further clarified by the following examples, which are intended to be purely exemplary of the present invention.

EXAMPLES

Example 1

Media Milled Dispersion

A media milled dispersion of Fanal pink (manufactured by BASF) was prepared from a mixture of 91.0 g of the Fanal pink pigment, 9.0 g of commercially available styrene butylacrylate polymer (piccotoner 1221) in 670.0 g of ethyl acetate (13.0% solids of mixture).

To 14.8 g of the Fanal Pink media milled dispersion were added 23.1 g of KAO C™ binder, 0.25 g of Bontron E88, and 26.2 g of ethyl acetate. This mixture, containing 7.0% pigment and 93.0% binder, comprised the organic phase in the evaporative limited coalescence process. The organic phase was mixed with an aqueous phase comprising 85 ml of pH 4 buffer containing 10.0 g of NALCO® 1060 and 2.2 ml of 10% weight of poly (adipic acid-comethylaminoethanol). This mixture was then subjected to very high shear using a POLYTRON™ sold by Brinkman, followed by a Microfluidizer. Upon exiting, the liquid phase was removed from the particles so formed by stirring overnight at room temperature in an open container. These particles were washed with 0.1N potassium hydroxide solution to remove the silica, then washed with water and dried. The toner particles, which contained 1.0 weight % of Bontron E88, were of the order of 6.2 $\mu$m volume average.

Example 2A

To 6.01 g of the cyan pigment, (Bridged Aluminum Phthalocyanine, and Copper Phthalocyanine pigments, manufactured by Eastman Kodak and BASF, respectively) media milled dispersion were added 24.18 g of KAO C™ binder, 0.25 g of Bontron E88, and 26.2 g of ethyl acetate. This mixture, containing 3.0% pigment and 97.0% binder, comprised the organic phase in the evaporative limited coalescence process. The organic phase was mixed with an aqueous phase comprising 85 ml of pH 4 buffer containing 4.25 g of NALCO® 1060 and 0.93 ml of 10% weight of poly (adipic acid-comethylaminoethanol). This mixture was then subjected to very high shear using a POLYTRON™ sold by Brinkman, followed by a Microfluidizer. Upon exiting, the liquid phase was removed from the particles so formed by stirring overnight at room temperature in an open container. These particles were washed with 0.1N potassium hydroxide solution to remove the silica, then washed with water and dried. The toner particles, which contained 1.0 weight % of Bontron E88, were of the order of 8.16 $\mu$m volume average.

Example 2

The procedure of Example 1 was repeated with the exception that 7.0 wt % of a mixture of a cyan pigment, Bridged Aluminum Phthalocyanine, and Copper Phthalocyanine pigments, manufactured by Eastman Kodak and BASF, respectively, replaced the Fanal Pink pigment. The resultant particles were of the order of 6.2 $\mu$m.

Example 3

The procedure of Example 1 was repeated with the exception that the Fanal Pink pigment was replaced by 7.0 wt % Pigment Yellow 180, manufactured by BASF. The resultant particles were of the order of 6.2 $\mu$m.

Example 4

The procedure of Example 1 was repeated with the exception that the Fanal Pink pigment was replaced by 5.0 wt % carbon black pigment, Regal 330$^R$ carbon black, manufactured by Cabot Corporation. The resultant particles were of the order of 6.4 $\mu$m.

Developers made from toners prepared in a manner similar to Examples 1–4 and a four-color set of polyester based pulverized toners of the same particle size were compared for long term stability. The carrier used for all eight developers was an iron-strontium ferrite coated with poly(vinylidine) fluoride. Stability was assessed using a life test device (LTD). The LTD consisted of a developer station of design similar to that described above and a rotating metal drum. Toner was developed onto the drum using an electrical bias, cleaned from the drum and discarded. Toner concentration in the developer station was held constant by addition of fresh toner controlled by a magnetic toner concentration monitor. Tests were carried out for approximately 100 hours, which is the equivalent of 500,000 pages of text.

Toner concentration (TC) and toner charge-to-mass (Q/m) were measured on samples of developer taken from the developer station every hour. The toner Q/m ratio was measured using an electrostatic device comprised of two spaced-apart, parallel, electrode plates which can apply both an electrical and magnetic field to the developer samples, thereby causing a separation of the two components of the mixture, i.e., carrier and toner particles, under the combined influence of a magnetic and electric field. A 0.100 g sample of a developer mixture was placed on the bottom metal plate. The sample was then subjected for thirty (30) seconds to a 60 Hz magnetic field and potential of 2000 V across the plates, which causes developer agitation. The toner particles were released from the carrier particles under the combined influence of the magnetic and electric fields and were attracted to and thereby deposited on the upper electrode plate, while the magnetic carrier particles were held on the lower plate. An electrometer measured the accumulated charge of the toner on the upper plate. The toner Q/m ratio in terms of microcoulombs per gram ($\mu$C/g) was calculated by dividing the accumulated charge by the mass of the deposited toner taken from the upper plate. TC was calculated by dividing the toner weight by the initial developer sample weight. By reversing the polarity of the applied potential, the amount and Q/m of wrong-sign toner could also be determined.

The particle size of the toner in the developer station was determined periodically by collecting toner from the top plate of the charge measuring device and measuring it with a Coulter Multisizer. The carrier was recovered from the bottom plate of the charge measuring device, mixed with fresh toner, and Q/m measured (referred to as strip and rebuilt Q/m) to determine whether the charging behavior of the carrier had changed during use.

Two methods were used to measure the tendency for toner to dust out of the developer station. In the first method, dust was collected from the development zone of the LTD using a small (¼ inch) vacuum tube placed near the development gap on the post-development side of the station. During 15 minutes of every hour, the vacuum was turned on and the dust was collected in a filter, which was weighed at the end of the collection period.

A second method of dust measurement was made by removing a sample of developer from the station and adding 50 mg/g of fresh toner. The added toner was mixed with the developer for 10 seconds in a mechanical shaker. Dusting of this sample and samples mixed further using a magnetic stirrer for 10, 30, 60 and 600 seconds were determined by placing the developer sample on the shell of a development roller and activating the rotating magnetic core of the roller for 60 seconds. Dust was collected on an outer concentric metal shell. The charge of the toner deposited on the outer shell was determined using an electrometer connected to it, and the mass of toner was determined by weighing the outer shell. In this way, the amount of dust and its charge to mass the were determined.

In FIG. 1, ground toner and chemically prepared toner were compared with respect to granularity. As can be seen in FIG. 1, the chemically prepared toner (e.g., cyan) and prepared in a similar fashion as Example 1, had a reduced amount of granularity throughout the entire density range set forth in FIG. 1. As indicated above, this reduced amount of granularity results in a greatly improved image quality. Images were developed by an SPD toning station on a photoconductor drum moving at a speed of 12 inch/sec, the toning sleeve rotating at 100 RPM and the 14 pole magnetic core rotating at 930 RPM. Granularity was computed from the data obtained by PDS micro-densitometer (As described in "Measurement of Graininess for Halftone Electrophotography," Theodore Bouk and Norman Burningham, Proceedings, IS&T's Eighth International Congress on Advances in Non-impact Printing Technology, pp. 506–510 (1992), incorporated in its entirety by reference herein.

Figure 2:
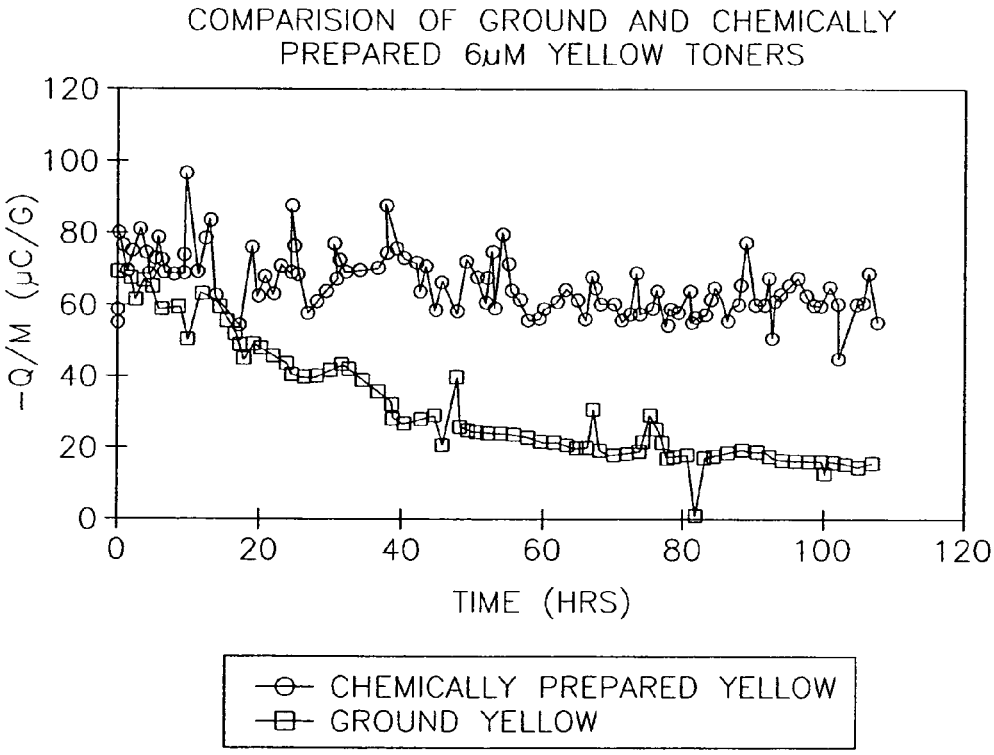
FIG. 2 is a graph comparing ground toner and chemically prepared toner with respect to charge stability over time.

FIG. 2 sets forth a comparison of ground toner with chemically prepared toner wherein both toners were used in the development system described in the present invention. As can be seen in FIG. 2, the charge stability was quite consistent for the chemically prepared toner compared to ground toner which is an unexpected result and is a desired benefit with respect to development systems. Furthermore, the developer dusting was low for the chemically prepared toner but increased as Q/m decreased for the ground toner. There was no wrong sign toner in at any time during the test with the chemically prepared toner. During the ground toner test, wrong sign toner began to appear in the developer when the dusting increased. Wrong sign toner and dust cause image degradation in the form of background in the white regions of the image. The strip and rebuilt Q/m did not change during the test for the chemically prepared toner. The strip and rebuilt Q/m for the ground toner decreased during the test in the same manner as Q/m measured for the developer in the developer station. This indicates that the chemically prepared toner did not cause the charging ability of the carrier to degrade, while the ground toner poisoned the charging ability of the carrier.

Three mechanisms which could be responsible for the observed Q/m decline of developers made with the ground toners have been considered: 1) buildup of high-charged toner fines on the carrier, 2) scumming of the carrier by toner polymer, and 3) chemical or physical modification of the carrier surface.

Figure 3:
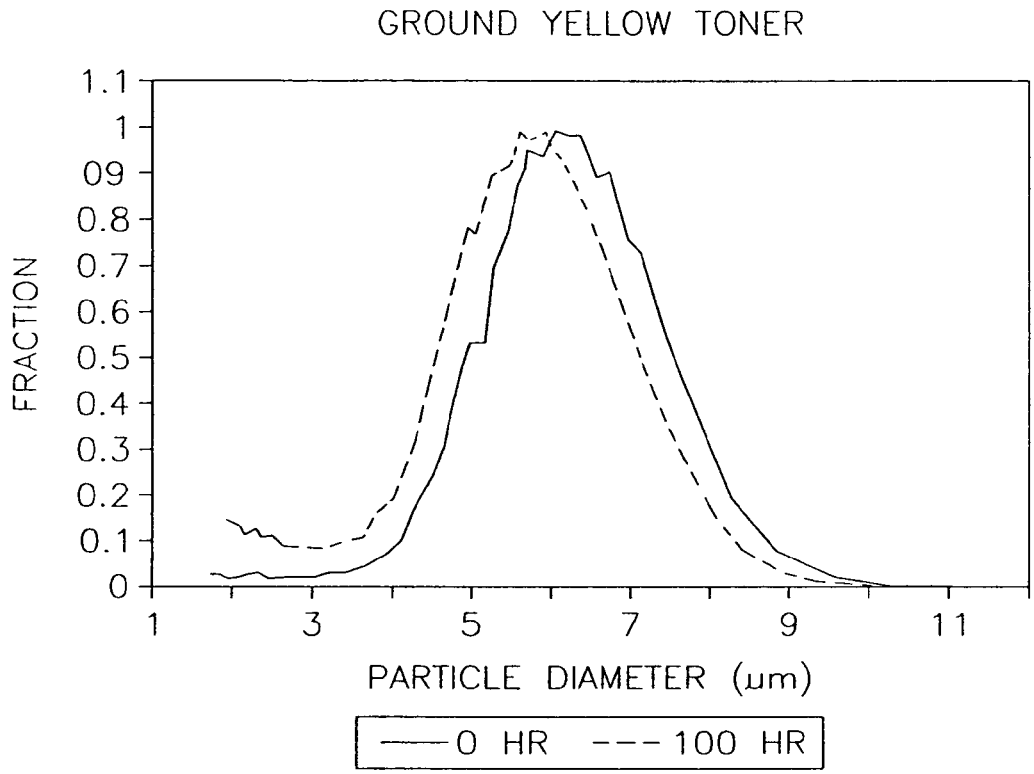
FIG. 3 is a graph showing particle diameter with respect to ground toner at time 0 hours and time 100 hours.
Figure 4:
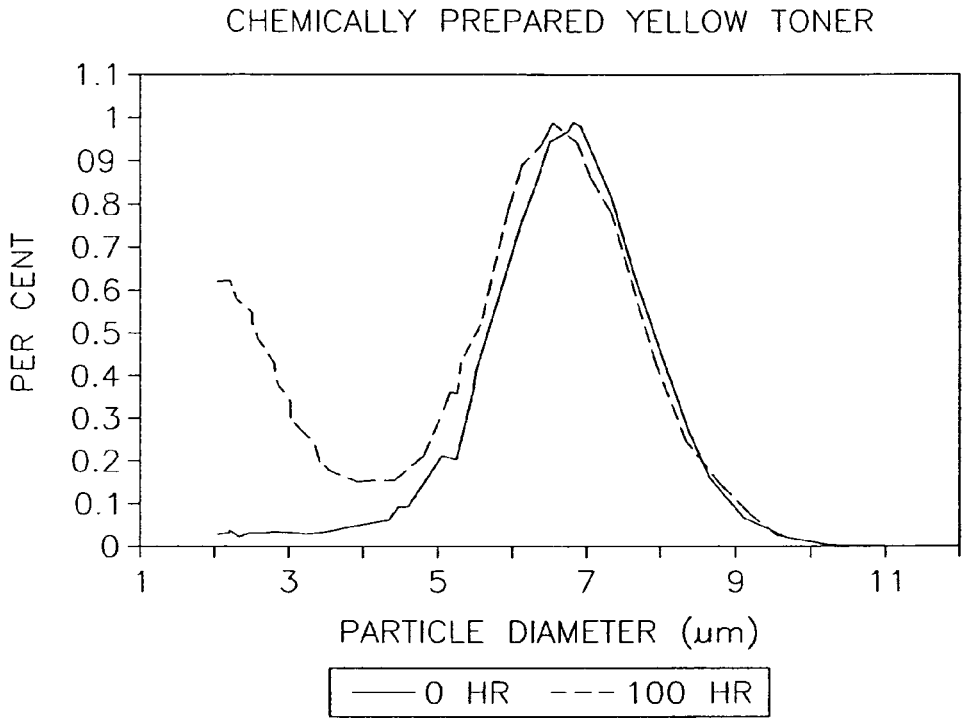
FIG. 4 is a graph showing particle diameter for a chemically prepared toner with respect to time equal 0 hour and time equal 100 hours.

With respect to FIGS. 3 and 4, as can be seen, over time, the particle diameters where essentially the same for the chemically prepared toner as shown in FIG. 4 (7.0 micron to 6.8 micron volume average diameter, which was not the case for ground toner as shown in FIG. 3 (6.6 micron to 6.2 micron volume average diameter). There was considerable buildup of fine particles for the chemically prepared toner during the test, but little buildup of fine particles for the ground toner. The presence of fine particles is normally associated with degradation of the developer, which was not the case for the chemically prepared toner. This is an unexpected result and is a desired benefit of chemically prepared toners with respect to development systems.

In order to test for toner scumming, selected samples of fresh and aged developers were extracted for 24 hours with dichloromethane (DCM). The weight of toner extracted is shown in Table 1 for yellow and black ground and chemically prepared toners. It can be seen from the table that there is little difference between the mass extracted from the chemically prepared toners ("CPT") and ground yellow toners. Charging measurements were made on the extracted carriers by rebuilding to a toner concentration of 6 wt % with the toners used for the LTD tests. The results of these measurements are also shown in Table 1 along with the strip and rebuilt charges and the running charges on the fresh and aged carrier.

Q/m of the CPT yellow toner during the test, the strip and rebuild Q/m for the fresh and aged carrier, and Q/m after DCM extraction are all near 60 $\mu$C/g. The running Q/m of the ground yellow toner decreased from about 80 to 20 $\mu$C/g during the test. The strip and rebuilt Q/m of carrier also declined from 70 to 20 $\mu$C/g. The extracted Q/m of the fresh carrier is higher than the starting Q/m of the test or the strip and rebuilt fresh carrier charge by about 60 $\mu$C/g. The extracted Q/m of the aged carrier is 39 $\mu$C/g, only slightly larger than the running Q/m or the strip and rebuild Q/m. Neither electrostatic stripping of the carrier, nor extraction with DCM led to recovery of the charging ability of the carrier aged with ground toner while Q/m of the carrier aged with CPT toner was uncharged by aging, stripping or extracting. This suggests that the decline in charge seen with the ground toner was related to chemical or physical change of the carrier coating.

The lack of degradation of the carrier caused by scumming surface by the chemically prepared toner is a highly desired property of a toner.

TABLE 1

Results of carrier extraction of DCM.

| Test ID | | | Mass | Charge-to-mass ($\mu$C/g) of Carrier | | |
|---|---|---|---|---|---|---|
| Strip/ Rebuilt | Toner | Age (hrs) | Extracted (w %) | Running | Extracted | Strip/ Rebuilt |
| A | CPT | 0 | 0.06 | −34.8 | −34.7 | −38 |
| | Black | 97 | 0.48 | −23.1 | −33.1 | −30 |
| B | GND | 0 | 0.07 | −48.1 | −61.8 | −64 |
| | Black | 106 | 0.91 | −21.7 | −26.9 | −18 |
| C | CPT | 0 | 0.01 | −67.2 | −52.7 | −61 |
| | Yellow | 107 | 1.10 | −55.0 | −58.1 | −56 |
| D | GND | 0 | 0.07 | −79.2 | −137 | −72 |
| | Yellow | 106 | 1.07 | −14.9 | −34.4 | −20 |

Other embodiments of the present invention will be apparent to those skilled in the art from consideration of the present specification and practice of the present invention disclosed herein. It is intended that the present specification and examples be considered as exemplary only with a true scope and spirit of the invention being indicated by the following claims and equivalents thereof.

What is claimed is:

1. A development system for toner comprising:

a supply of dry developer mixture comprising chemically prepared toner particles and hard magnetic carrier particles;

a non-magnetic, cylindrical shell for transporting the developer from said supply to a development zone, wherein said shell is rotatable or stationary;

a rotating magnetic core of a pre-selected magnetic field strength; and means for rotating at least said magnetic core to provide for the transport of said toner particles from said shell to an electrostatic image.

2. The development system of claim 1, wherein said chemically prepared toner particles comprise at least one toner resin, at least one release agent, at least one surface treatment agent, and optionally at least one charge control agent or colorant or both.

3. The development system of claim 2, wherein said surface treatment agent comprises silica.

4. The development system of claim 2, wherein said surface treatment agent comprises at least one metal oxide.

5. The development system of claim 2, wherein said surface treatment agent comprises at least one inorganic oxide.

6. The development system of claim 2, wherein said surface treatment agent comprises at least one polymeric material.

7. The development system of claim 2, wherein said at least release agent comprises at least one wax and said at least one toner resin comprises at least one polyester or at least one styrene acrylic based toner resin.

8. The development system of claim 2, wherein said at least one resin is present in an amount of from about 80% to about 95%, said release agent is present in an amount of from about 0.5% to about 5.0%, and said surface treatment agent is present on the toner particles in an amount of from about 0.05% to about 2.0%, all based on the weight of the toner particles.

9. The development system of claim 1, wherein said chemically prepared toner particles are formed from an evaporation limited coalescence reaction.

10. The development system of claim 1, wherein said chemically prepared toner particles are formed by suspension polymerization.

11. The development system of claim 1, wherein said chemically prepared toner particles have a partial size of about 6 microns or less.

12. The development system of claim 1, further comprising a fuser.

13. A method for developing an electrostatic image with chemically prepared toner particles comprising developing an electrostatic image member bearing an electrostatic image pattern by moving the image member through a development zone and transporting developer through the development zone in developing relation with the charge pattern of the moving imaging member by rotating an alternating-pole magnetic core of a pre-selected magnetic field strength within an outer non-magnetic shell, which is rotating or stationary, and controlling the directions and speeds of the core and optionally the shell rotations so that developer flows through the development zone in a direction co-current with the image member movement, wherein said developer comprises charged toner particles and oppositely charged hard magnetic carrier particles.

14. The method of claim 13, wherein said toner particles comprise at least one toner resin, at least one release agent, at least one surface treatment agent, and optionally at least one charge control agent or colorant or both.

15. The method of claim 13, wherein said method has a developer flow, and said moving imaging member and said developer flow are moving at substantially the same speed.

16. The method of claim 13, wherein said carrier particles comprise hard magnetic material exhibiting a coercivity of at least about 300 gauss when magnetically saturated and also exhibit an induced magnetic moment of at least about 20 EMU/gm when in an externally applied field of 1,000 gauss.

17. The method of claim 13, wherein said toner particles comprise a spacing agent on the surface of said toner particles.

18. The method of claim 17, wherein said spacing agent comprises silica.

19. The method of claim 17, wherein said spacing agent comprises at least one metal oxide.

20. The method of claim 17, wherein said spacing agent comprises at least one inorganic oxide.

21. The method of claim 17, wherein said spacing agent comprises at least one polymeric material.

22. The method of claim 17, wherein said spacing agent is present in an amount of from about 0.05 to about 1.5 wt %, based on the weight of the toner.

23. The method of claim 13, further comprising transferring said electrostatic image pattern onto a substrate and fusing said electrostatic image on said substrate by passing the substrate through or under a fuser.

* * * * *